US008758174B2

(12) United States Patent
Thoman et al.

(10) Patent No.: US 8,758,174 B2
(45) Date of Patent: Jun. 24, 2014

(54) TABLE TENNIS ROBOT AND METHOD OF OPERATION

(75) Inventors: Michael Lawrence Thoman, Gallatin, TN (US); Burak Cevik, Cincinnati, OH (US)

(73) Assignee: Newgy Industries, Inc., Gallatin, TN (US)

( * ) Notice: Subject to any disclaimer, the term of this patent is extended or adjusted under 35 U.S.C. 154(b) by 298 days.

(21) Appl. No.: 13/500,774

(22) PCT Filed: Oct. 27, 2010

(86) PCT No.: PCT/US2010/054253
§ 371 (c)(1),
(2), (4) Date: Apr. 6, 2012

(87) PCT Pub. No.: WO2011/056641
PCT Pub. Date: May 12, 2011

(65) Prior Publication Data

US 2012/0196707 A1 Aug. 2, 2012

Related U.S. Application Data

(60) Provisional application No. 61/255,757, filed on Oct. 28, 2009, provisional application No. 61/255,795, filed on Oct. 28, 2009.

(51) Int. Cl.
*A63B 69/00* (2006.01)

(52) U.S. Cl.
USPC ..... 473/459

(58) Field of Classification Search
USPC ..... 473/459, 436; 124/1, 6, 49, 78, 81
See application file for complete search history.

(56) References Cited

U.S. PATENT DOCUMENTS 4,844,458 A * 7/1989 Gatchel et al. ..... 473/436
4,854,588 A * 8/1989 Gatchel et al. ..... 473/436

(Continued)

FOREIGN PATENT DOCUMENTS

JP 3008223 12/1994
JP 3008223 U9 12/1994

(Continued)

OTHER PUBLICATIONS

Search Report and Written Opinion; PCT App. No. PCT/US2010/054253; Filed Oct. 27, 2010.

*Primary Examiner* — Raleigh W Chiu
(74) *Attorney, Agent, or Firm* — Polster Lieder

(57) ABSTRACT

A robot server assembly (20) having a back panel (21), a ball feed collector plate (23) extending outwardly from the bottom of back panel with its horizontal plane positioned an angle relative to the longitudinal axis of the back panel (21), a rotatable ball pickup mechanism (24) positioned between a the ball collector mounting section (22) of the back panel and the ball feed collector plate and having a plurality of ball pickup structures (78, 80, 81, 82) extending into the collector plate; a ball guide (25) at the upper end of the back panel; a substantially transparent front cover (28) attached to the front surface of the back panel (21) and extending from the bottom of the ball guide (25) to ball pickup mechanism (24) to define an enclosed ball passageway (30); an oscillator (32) is mounted to the top of the back panel above the ball guide, with a serving head assembly (34) attached to the oscillator through a pivot guide (35). The robot server assembly (20) includes a digital controller (204) that operates multiple functions of the robot server assembly from a menu of functions and can be interfaced with a personal computer for the development of specialized drills.

21 Claims, 16 Drawing Sheets

(56) References Cited

U.S. PATENT DOCUMENTS

| | | | | |
|---|---|---|---|---|
| 5,335,905 | A | 8/1994 | Newgarden | |
| 5,383,658 | A | 1/1995 | Newgarden | |
| 5,485,995 | A | 1/1996 | Newgarden | |
| 5,566,936 | A | 10/1996 | Newgarden | |
| 5,607,151 | A * | 3/1997 | Daley | 124/78 |
| 6,186,132 | B1 * | 2/2001 | Ko | 124/6 |
| 6,371,872 | B1 * | 4/2002 | Daley | 473/460 |
| 6,406,386 | B1 * | 6/2002 | Brazzell | 473/431 |
| 6,604,517 | B1 * | 8/2003 | Chao et al. | 124/16 |
| 7,736,249 | B2 * | 6/2010 | Zhang | 473/475 |
| 2007/0238555 | A1 * | 10/2007 | Fang | 473/431 |

FOREIGN PATENT DOCUMENTS

| | | |
|---|---|---|
| JP | 11089990 | 4/1999 |
| JP | 11089990 A | 4/1999 |
| JP | 3071345 | 6/2000 |
| JP | 3071345 U9 | 6/2000 |
| WO | 0197928 | 12/2001 |

* cited by examiner

| MENU ITEM/ BUTTON | VALUE | EXPLANATION |
|---|---|---|
| | | |
| MAIN MENU | | |
| NORMAL | | NORMAL MENU IS USED BY PLAYER WANTING TO CONTROL ROBOT BY MANUALLY SETTING EACH CONTROL |
| DRILL | | DRILL MENU ALLOWS THE USER TO SELECT FROM A NUMBER OF PRE-PROGRAMMED DRILLS (PATTERNS) AND PERMITS THE USER TO ADJUST THE SPEED AND FREQUENCY OF THE SHOTS UP OR DOWN FROM THE PRE-SET LEVEL |
| PC | | THE PC MENU IS USED WHEN THE USER HAS THE CONTROLLER HOOKED UP TO A COMPUTER. SOFTWARE ON THE COMPUTER ALLOWS USERS TO DESIGN THEIR OWN DRILLS AND SAVE/SHARE THEIR DRILL FILES. |
| SETUP | | SETUP MENU IS FOR SELECTING USER PREFERENCES AND FOR CALIBRATING HARDWARE. |
| | | |
| NORMAL MENU | | |
| BALL SPEED | 00~30 | CONTROLS THE SPEED OF THE BALL SPEED MOTOR |
| L POSITION | 00~20 | SETS THE LEFTMOST POSITION WHERE THE BALL WILL BE DELIVERED. CHANGING L POSITION CAUSES R POSITION TO CHANGE TO SAME VALUE. |
| R POSITION | 00~20 | SETS THE RIGHTMOST POSITION WHERE THE BALL WILL BE DELIVERED. IF SET THE SAME AS L POSITION, THEN BALL WILL BE DELIVERED TO ONLY ONE SPOT. |
| WAIT | 00.35~50.00 sec | SETS THE AMOUNT OF TIME (INTERVALS) BETWEEN SUBSEQUENT SHOTS IN SECONDS. |
| COUNT | 0000~9990 | LIMITS THE NUMBER OF SHOTS THAT WILL BE DELIVERED BEFORE BALL DELIVERY IS STOPPED. CHANGING COUNT WILL ALSO CHANGE TIME. IF COUNT IS SET TO 0, THEN COUNT IS IGNORED |
| TIME | 0:00:00~ 9:59:59 | SETS THE AMOUNT OF TIME THE ROBOT WILL DELIVER BALLS BEFORE IT STOPS. CHANGING TIME WILL ALSO CHANGE COUNT. IF TIME IS 0, THEN TIME IS IGNORED. |

FIG. 14A

| MENU ITEM/ BUTTON | VALUE | EXPLANATION |
|---|---|---|
| OSC RANDOM | ON, OFF | PROVIDES RANDOMNESS IN BALL PLACEMENT. IF ON. BALLS ARE PLACED RANDOMLY BETWEEN THE L POSITION AND R POSITION. |
| SPEED RANDOM | 00~10 | VARIES BALL SPEED BY RANDOMLY ADDING THE VALUE TO BALL SPEED. E.G., BALL SPEED SET AT 15 AND SPD RANDOM SET AT 3. SPEED OF BALL WILL RANDOMLY VARY AMONG 15, 16, 17, AND 18. |
| WAIT RANDOM | 0.00~1.00 | PROVIDES FOR RANDOMLY INCREASING THE WAIT BETWEEN SHOTS IN INTERVALS OF 0.05 SECONDS. VALUE IS ADDED TO WAIT. E.G., WAIT IS 1.00 AND WAIT RANDOM IS 0.10. THE WAIT BETWEEN SHOTS WILL VARY AMONG 1.00, 1.05, AND 1.10 SECONDS. |
| | | |
| DRILL MENU | | |
| DRILL # | 01~64 | SELECTS DRILL'S ID #. DRILLS DESCRIBED IN OWNER'S MANUAL. THERE ARE 64 FACTORY DEFAULT DRILLS. FIRST 32 (#'S 1-32) CANNOT BE CHANGED, SECOND 32 (#'S 33-64) CAN BE OVERWRITTEN BY USING A COMPUTER AND THE PROVIDED SOFTWARE (ROBO-SOFT). |
| SPIN | TOP, BACK, R SIDE, L SIDE, TOP/RIGHT, TOP/ LEFT, BACK/ RIGHT, BACK/ LEFT | THESE 2 SETTINGS ARE DETERMINED WHEN DRILL # IS SELECTED AND ARE PROVIDED SO USER CAN SET THESE MANUALLY ON THE ROBOT HEAD. THESE SETTINGS CANNOT BE CHANGED FROM THE CONTROL BOX-YOU MUST USE ROBO-SOFT TO OVERWRITE THE DRILL SETTINGS. |
| HEAD ANGLE | 01~13 | |
| WAIT ADJUST | 100%~+900% | ADJUSTS WAIT TO GO SLOWER (PLUS VALUES) OR FASTER (MINUS VALUES) THAN THE PRE-SET VALUE. |
| SPEED ADJUST | -9~+9- | ADJUSTS BALL SPEED TO GO SLOWER (MINUS VALUES) OR FASTER (PLUS VALUES) THEN THE PRE-SET VALUE. |
| # OF REPS | 0000~9999 | SETS THE NUMBER OF REPITITIONS OF EACH PATTERN. E.G., IF DRILL #1 CONSISTS OF 3 SHOTS, AND THE # OF REPS IS 5, THEN 5 REPETITIONS OF PATTERN 1 WILL BE DELIVERED (15 SHOTS TOTAL). OF # OF REPS IS 0, THEN # OF REPS IS IGNORED. |

FIG. 14B

| MENU ITEM/ BUTTON | VALUE | EXPLANATION |
|---|---|---|
| TIME | 0:00:00~ 9:59:59 | SHOWS THE AMOUNT OF TIME FOR RUNNING THE THE NUMBER OF REPETITIONS SET UNDER THE # OF REPS. CAN ALSO BE MANUALLY CHANGED TO A CERTAIN AMOUNT OF TIME AND THE # OF REPS WILL CHANGE ACCORDINGLY. IF TIME IS 0, THEN TIME IS IGNORED. |
| | | |
| PC | | |
| PC MODE | NONE | USED WHEN THE CONTROLLER IS HOOKED UP TO A COMPUTER AND THE COMPUTER IS CONTROLLING THE ROBOT. ALSO USED WHEN USER IS PROGRAMMING THE USER DEFINABLE DRILLS (#'S 33-64) THAT APPEAR IN THE DRILL MENU. |
| MAKE CONNECTION | | |
| TO PC | | |
| RUN ROBO-SOFT | | |
| | | |
| SETUP | | |
| CONTRAST | 00~30 | ALLOWS THE USER TO ADJUST THE CONTRAST OF THE SCREEN FOR VARIOUS LIGHTING SITUATIONS AND AGE OF THE SCREEN. A VALUE OF 0 IS VERY LIGHT AND A VALUE OF 30 IS VERY DARK. DEFAULT = 15. |
| HAND | LEFT, RIGHT | ALLOWS THE USER TO INPUT THEIR DOMINANT HAND SO THAT FOREHAND/BACKHAND PLACEMENTS IN DRILLS ARE CORRECT. DEFAULT = RIGHTY. DOES NOT AFFECT NORMAL MODE. |
| LANGUAGE | EN, DE, FR, ES, CN, JP | ALLOWS THE USER TO SELECT THE LANGUAGE FOR THE DISPLAY. 6 LANGUAGES ARE SUPPORTED - ENGLISH, GERMAN, FRENCH, SPANISH, CHINESE, AND JAPANESE. DEFAULT = EN. |
| OSC CALIB | 00~50 | ADJUSTS SERVO SO POSITION SETTING OF 10 CORRELATES WITH THE CENTERLINE OF THE TABLE. WHEN 10 SETTING IS CORRECT, OTHER POSITION VALUES ARE CORRECT. DEFAULT = 25. SET TO TOPSPIN AND HEAD ANGLE 8, THEN PRESS TEST TO THROW 5 BALLS TO CHECK LANDING SPOTS. |
| SENSOR CALIB | 00~20 | ADJUSTS BALL SENSOR THAT COUNTS EACH BALL AS IT IS THROWN. DEFAULT = 10. SET TO BACKSPIN AND HEAD ANGLE TO 7, THEN PRESS TEST. BALLS WILL BE THROWN INTO THE TABLE'S NET AND WILL ROLL BACK INTO THE ROBOT'S NET. WATCH FOR MISSED OR DOUBLE THROWS. |

FIG. 14C

| MENU ITEM/ BUTTON | VALUE | EXPLANATION |
|---|---|---|
| ALARM CALIB | 00~20 | ADJUSTS SENSITIVITY OF BALL JAM ALARM, WHICH SHUTS OFF POWER TO THE BALL FEED MOTOR WHEN RESISTANCE IS DETECTED OVER A PRE-SET VALUE. MAY ALLOW ROBOT TO BE USED WITH DIRTY OR NEW BALLS OR BE SET FOR INCREASED SENSITIVITY FOR ADDED SAFETY. DEFAULT = 10. |
| SPEED CALIB | 00~20 | USED TO CALIBRATE BALL SPEED TO A 6 INCH SQUARE TARGET POSITIONED AT THE CENTER ENDLINE. TARGET SUPPLIED IN OWNER'S MANUAL. SET TO TOPSPIN WITH HEAD ANGLE 8, THEN PRESS TEST TO THROW 5 BALLS AT BALL SPEED 18. ALL BALLS SHOULD LAND ON TARGET. DEFAULT = 10. |
| | | |
| LANGUAGE SELECTION MENU | | |
| RELEASE BUTTON | NONE | ALTERNATIVE WAY TO SELECT LANGUAGE IF USER CANNOT READ THE MENUS. HOLD MENU BUTTON DOWN UNTIL DISPLAY STARTS BLINKING. THEN HOLD UP BUTTON DOWN UNTIL CORRECT LANGUAGE APPEARS, THEN RELEASE BUTTON. LANGUAGE CHANGES EVERY 2 SECONDS. |
| WHEN YOU SEE | | |
| YOUR LANGUAGE | | |
| | | |
| BALL UNLOADING MENU | | |
| BALL UNLOADING | | HOLD MENU BUTTON DOWN UNTIL DISPLAY STARTS BLINKING. THEN PRESS DOWN BUTTON TO ACTIVATE THIS FEATURE. WAIT IS SET TO MINIMUM AND BALL SPEED TO 1. USER PLACES A TRAY UNDER THE HEAD AND IT WILL TAKE ONLY A MINUTE OR TWO FOR THE ROBOT TO FILL THE TRAY WITH BALLS. USER THEN PRESSES THE STOP OR MENU BUTTON TO STOP BALL UNLOADING |
| PLACE TRAY UNDER | | |
| ROBOT HEAD | | |

FIG. 14D

| MENU ITEM/ BUTTON | VALUE | EXPLANATION |
|---|---|---|
| | | |
| FACTORY DEFAULT RESTORATION MENU | | |
| RESTORING FACTORY DEFAULTS | NONE | HOLD MENU BUTTON DOWN UNTIL DISPLAY STARTS BLINKING. THEN PRESS THE MINUS BUTTON TO SEE THESE MESSAGES. RESTORE ALL SETTINGS TO FACTORY DEFAULT VALUES. |
| FOLLOWED BY | | |
| FACTOR DEFAULTS RESTORED | NONE | |
| | | |
| SYSTEM TEST MENU | | |
| TESTING SYSTEM GIVE ERROR #'S TO TECHNICIAN | WILL GENERATE A SERIES OF NUMBERS | HOLDING THE MENU BUTTON DOWN WILL CAUSE DISPLAY TO START BLINKING. THEN PRESS PLUS BUTTON TO ACTIVATE SYSTEM DIAGNOSTICS. ERROR CODES WILL BE DISPLAYED. CODES WILL BE DISPLAYED. THEY CAN BE GIVEN TO A TRAINED SERVICE TECHNICIAN TO IDENTIFY FAILING COMPONENTS. |
| | | |
| BUTTONS | | |
| POWER (ORANGE) | NONE | TURNS CONTROLLER ON AND OFF. |
| TEST (YELLOW) | NONE | WHEN IN NORMAL MODE, IF PRESSED AND QUICKLY RELEASED, THROWS OUT ONE BALL. IF PRESSED AND HELD, NUMBER ON SCREEN ADVANCES UNTIL RELEASED. WHEN IN DRILL MODE, PRESSING BUTTON SHOWS A DRILL PREVIEW THAT INDICATES PLACEMENT OF EACH BALL IN A DRILL. ALSO USED IN CALIBRATION MODES (SEE ABOVE). |
| STOP/START (RED/GREEN) | NONE | STARTS AND MANUALLY STOPS DELIVERY OF BALLS. |
| MENU/OK (WHITE) | NONE | ALLOWS ACCESS TO THE MAIN MENU AND PERMITS USERS TO ENTER A SELECTED VALUE. |
| UP (GRAY) | NONE | SCROLLS UP ONE LINE ON THE MENU WITH EACH PRESS. |
| DOWN (GRAY) | NONE | SCROLLS DOWN ONE LINE IN THE MENU WITH EACH PRESS. |

FIG. 14E

| MENU ITEM/ BUTTON | VALUE | EXPLANATION |
|---|---|---|
| MINUS (-) (GRAY) | NONE | QUICK PRESS DECREASES VALUE BY ONE UNIT. PRESS AND HOLDING DECREASES VALUE BY MULTIPLE UNITS. |
| PLUS (+) (GRAY) | NONE | QUICK PRESS INCREASES VALUE BY ONE UNIT. PRESS AND HOLDING INCREASES VALUE BY MULTIPLE UNITS. |
| | | |
| ALERTS | | |
| WRONG VOLTAGE CHECK TRANSFORMER | NONE | DISPLAYS WHENEVER AN INCORRECT OR FAULTY TRANSFORMER IS PLUGGED INTO UNIT. ALERT IS TRIGGERED WHENEVER INCOMING VOLTAGE IS LESS THAN 14.5V OR MORE THAN 15.5V. |
| BALL JAM ALARM CHECK BALL CHANNEL | NONE | DISPLAYS WHENEVER RESISTANCE OF BALL FEED MOTOR GOES OVER A PRE-DETERMINED SAFETY LEVEL. TYPICALLY CAUSED BY A BROKEN OR OVERSIZED BALL OR FOREIGN OBJECT JAMMED INSIDE BALL CHANNEL OR BALL PICKUP MECHANISM. ALSO ACTIVATES IF CONNECTOR CABLE IS NOT PLUGGED IN SECURELY. |

FIG. 14F

TABLE TENNIS ROBOT AND METHOD OF OPERATION

CROSS-REFERENCE TO RELATED APPLICATIONS

This application is the United States National Stage under 35 U.S.C. §371 of International Application Serial No. PCT/US2010/054253, having an international Filing Date of Oct. 27, 2010. International Application Serial No. PCT/US2010/054253 claims priority to provisional application Ser. No. 61/255,757, filed Oct. 28, 2009 and to Ser. No. 61/255,795, filed Oct. 28, 2009, both of which are incorporated herein by reference.

BACKGROUND

This disclosure relates to a robot server assembly for serving table tennis balls, and more specifically to a robot server assembly that is portable, low cost, less prone to jamming and has improved ball pick up features.

Table tennis is a popular competitive and recreational sport. The object of the game is to have a player on each side of the table so that each player with a table tennis paddle can serve, return and rally a table tennis ball. Often, however, a player may wish to play the game of table tennis without another player. To that end, various table tennis ball serving devices or robots have been developed. The devices serve the ball to the player so that the player can return the shot in the direction of the robot.

Heretofore table tennis robots have incorporated various features. U.S. Pat. No. 3,794,001 to Newgarden describes a relatively simple device for imparting variations in the amount of spin applied to a ball being served by the server. The disclosure of the U.S. Pat. No. 3,794,001 is incorporated herein by reference.

U.S. Pat. No. 4,844,458 is directed to a table tennis robot with a panning head; U.S. Pat. No. 4,854,588 describes a table tennis robot capable of variations in shot trajectory; U.S. Pat. No. 4,917,380 discloses a table tennis robot having lateral, foldable troughs with a net array that captures balls, allows them to drop to the troughs where they are fed to the robot server; and U.S. Pat. No. 5,009,421 discloses a portable table tennis serving devices that include a robot server and a ball capture net. These last two recited patents employ a folding net structure is also employed for attachment to a table tennis table and for feeding balls to a robot ball server. The net structure includes a plurality of arms extending radially from a central member and netting suspended between the arms. The netting has a lower edge which is cooperatively connected with a trough device for receiving balls that fall from the netting. The trough is disposed to feed the balls to the robot serving device. The disclosures in the above described patents are incorporated by reference herein.

While many of the devices previously known to the art are functional and useful, they sometimes are susceptible to jamming when returned balls are captured and collected and fed into the mechanism for recycling the ball to the robot server.

It is desirable, therefore, to have a sophisticated server device for sequentially serving a plurality of balls to the player employing a relatively simple, inexpensive design, which addresses the ball jamming problem and which can be offered at reasonable price points to the customer.

SUMMARY OF THE DISCLOSURE

Briefly stated, a robot server assembly having a back panel with a rounded ball collector mounting section at the bottom.

A ball feed collector plate extends outwardly from the bottom of back panel. A ball pickup mechanism is operatively positioned between with the ball collector mounting section and the ball feed collector plate. There is an upper ball guide at the upper end of the back panel. A front cover is attached to the front surface of the back panel and extends from the bottom of the ball guide to ball pickup mechanism defining an enclosed ball passageway. An oscillator is mounted to the top of the back panel above the upper ball guide and a serving head assembly is attached to the oscillator through a pivot guide.

In one aspect, the front cover has a substantially U-shaped cross-sectional configuration to eliminate angles and corners and facilitates ball movement through the ball feed passage thereby reducing jamming.

In one aspect, the front cover can be substantially transparent to the extent it allows viewing of balls moving within the ball feed passage.

In one aspect, the serving head assembly comprises a discharge wheel and a discharge tube. In one aspect of the invention, the discharge tube has a fluted bore. In one aspect the serving head assembly comprises a pair of opposed discharge wheels having replaceable friction material. One or more discharge wheels may operatively extend into the bore of the fluted discharge tube.

In one aspect, the ball collector plate has a contoured configuration that reduces ball hang up, gathering and jamming and is angled relative to the longitudinal axis of the robot to facilitate ball feed and pickup.

Another aspect of the ball pickup mechanism comprises a rotatable pickup wheel having a plurality of resilient pickup fingers that enhance ball pickup by the ball pickup mechanism. In another aspect, the pickup wheel comprises a plurality of ball feed springs of varying lengths and configurations that enhance ball pickup by the ball pickup mechanism.

Another aspect of the disclosure is a ball guide design that prevents hang-up of the table tennis balls at the juncture where they enter the serving head.

Yet another aspect of the disclosure is a robot server assembly that can be expanded to accept a net assembly or trough assembly.

BRIEF DESCRIPTION OF THE DRAWINGS

FIG. 3 is a side elevational view there of;

FIG. 14A-14F is a table listing the menu choices and corresponding functions displayed on the digital controller.

DETAILED DESCRIPTION

Figure 1:
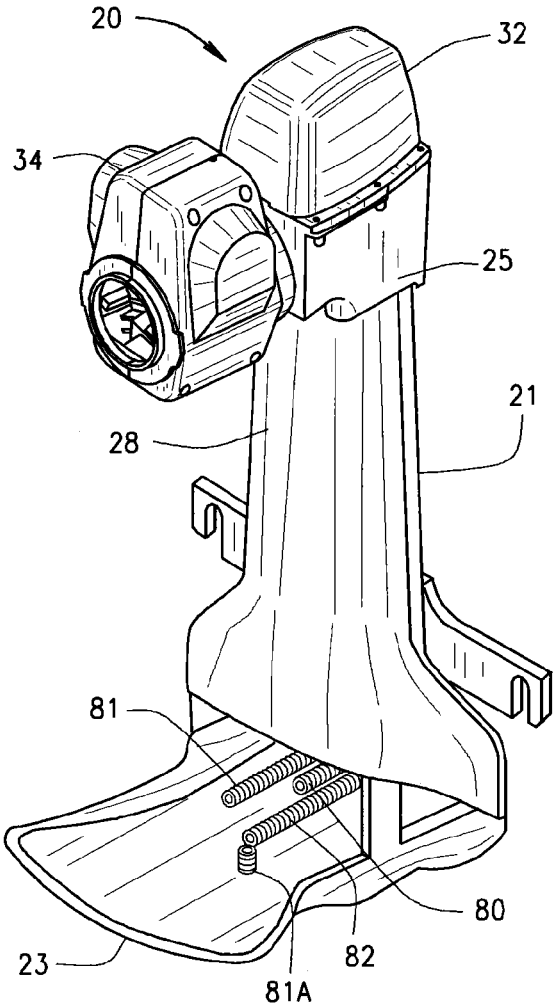
FIG. 1 is a perspective view of an embodiment of a robot server assembly constructed in accordance with the present disclosure.

While this disclosure is susceptible of embodiment in many different forms, there is shown in the drawings and will herein be described in detail preferred embodiments of the disclosure with the understanding that the present disclosure is to be considered as an exemplification of the principles of the disclosure and is not intended to limit the broad aspect of the disclosure to the embodiments illustrated.

Referring now to the drawing figures, one illustrative embodiment of robot server assembly 20 is shown. The robot server assembly 20 contains an elongated back panel 21 with a rounded ball collector mounting section 22 at the bottom. A ball feed collector plate 23 extends outwardly at a right angle from the bottom of back panel 21. A ball pickup mechanism 24 is operatively associated with the ball collector mounting section 22 of the back panel. There is an upper ball guide 25 at the upper end of the back panel. A front cover 28 is removably attached to the front surface of the back panel 21 and extends from the bottom of the ball guide 25 to the top of the ball feed collector plate 23, partially covering the ball pickup mechanism 24. Front cover 28 and the back panel define an enclosed ball passageway 30, as will be addressed below. An oscillator 32 is mounted to the top of the back panel 21 above the upper ball guide 25. A serving head assembly 34 is attached to the oscillator 32 through a pivot guide 35. Various aspects of the foregoing elements will be discussed in detail hereinafter.

Figure 4:
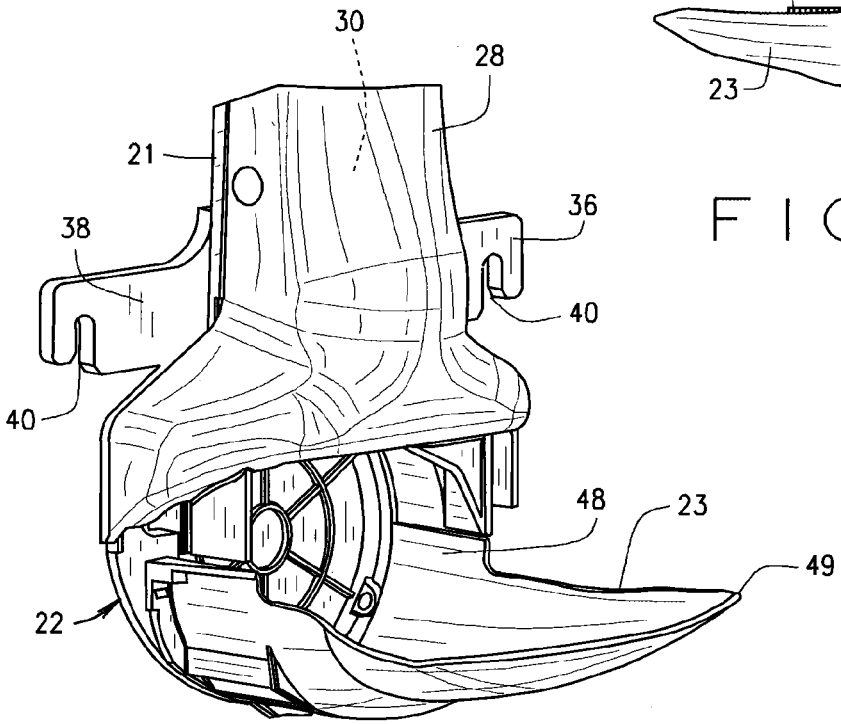
FIG. 4 is an isometric view of the lower section of the robot server assembly, sans ball pickup mechanism, illustrating the ball tray and opening to the ball pickup mechanism.

The robot server assembly can be mounted in a container such as a ball bucket or basket or can be detachably mounted directly onto the edge of a table tennis table by employing attachment means as set out in U.S. Pat. No. 5,485,995, which is incorporated herein by reference. As shown in FIG. 4, in one aspect the table tennis robot back panel 21 includes two mounting arms 36 and 38 each having a slot 40 for mounting the robot server assembly. The mounting arms can be employed to removably mount the robot in the base container component of a robot table tennis net and server assembly of the type disclosed in U.S. Pat. No. 5,335,905, which is incorporated herein by reference. The robot of present invention may include lateral, foldable troughs with a net array that captures balls, allows them to drop to the troughs where they are fed to the robot server. The net structure includes a plurality of arms extending radially from a central member and netting suspended between the arms. The netting has a lower edge which is cooperatively connected with the troughs for receiving balls that fall from the netting. The trough is disposed to feed the balls to the robot serving device.

The back panel 21 has a first side wall 42 that is perpendicular to front surface of the back panel and extends from the top of the back panel to a point just above the ball pickup mechanism 24. A lower portion of the first side wall curves toward the center of the ball pickup mechanism. A spaced apart second side wall 44 is perpendicular to the front surface of the back panel 21 and extends from the top of the back panel 21 to meet at a top surface of the ball feed collector plate 23. A lower portion of second side wall 42 curves from an edge of the ball feed collector plate 23 toward the center of the back panel 21. Together, the recited first and second side walls and back panel 21 form a ball channel 45. The curved portions of the first and second side walls are designed to guide balls exiting the ball pickup mechanism 24 into the ball channel.

A ball feed sensor and check valve 47 are mounted on the back panel 21 such that each table tennis ball travelling through the ball channel will activate the switch. The check valve prevents a ball from falling back through the ball channel and falsely activating the ball sensor switch.

Figure 2:
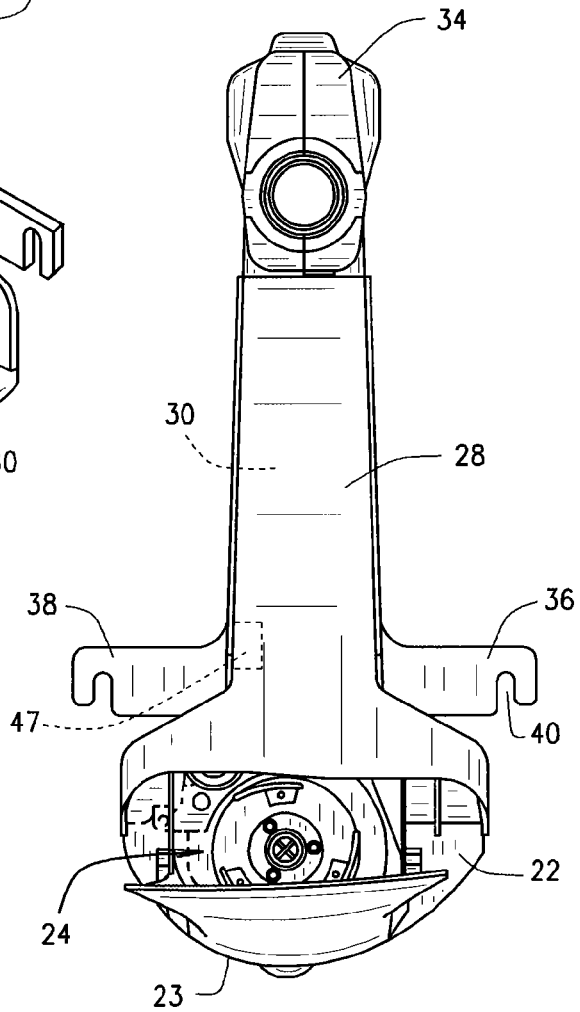
FIG. 2 is a front elevational view of an embodiment of FIG. 1.
Figure 3:
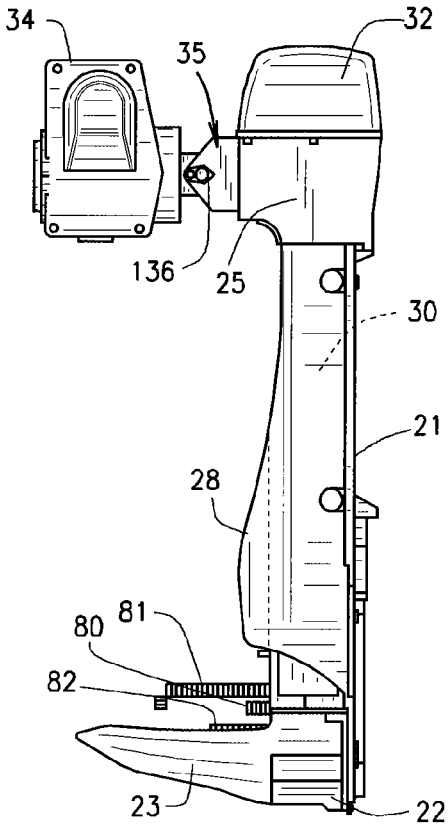

The ball feed collector plate 23, illustrated in FIG. 4, is generally concave or dish-shaped and has a mounting flange 48 that conforms to the radius of the ball collector mounting section 22 at the bottom of back panel 21. The ball feed collector plate 23 is attached to back panel 21 with screws or any other suitable attachment means. As best seen in FIG. 2, ball feed collector plate 23 is tilted or angled toward one side such that the horizontal plane of the collector plate is angled relative to the longitudinal axis of the robot itself. Moreover, plate 23 is sloped toward the ball pickup mechanism 24 to provide a gravitational force for urging balls toward the left side of the ball pickup mechanism, where the balls have a higher probability of being picked up by the ball pickup mechanism. The ball feed collector plate 23 features an upwardly sloping front lip 49 to prevent balls from spilling out. The ball feed collector 23 is constructed of plastic containing an anti-static additive to help prevent static from pushing balls away from the ball pickup mechanism 24.

Figure 5:
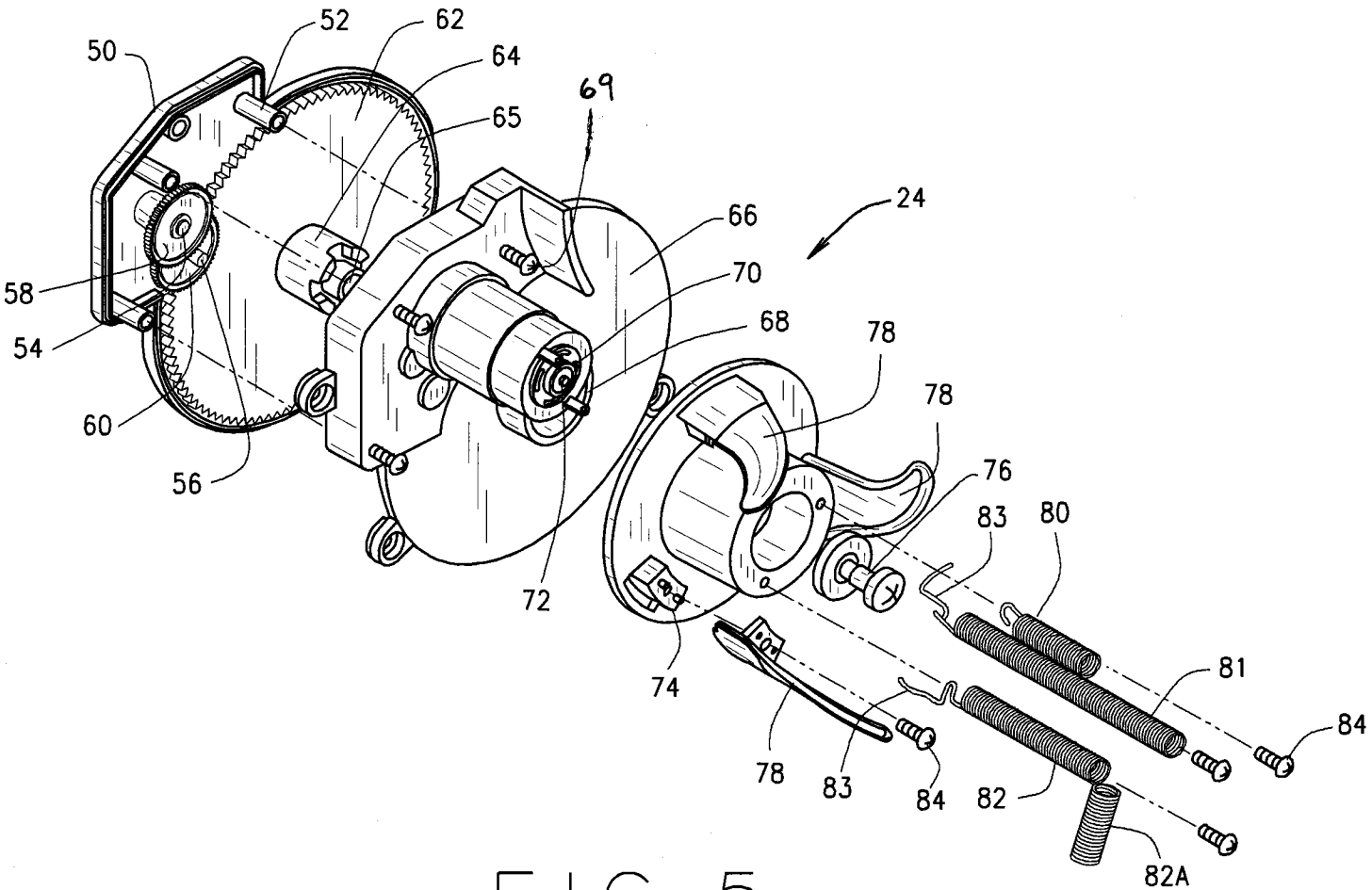
FIG. 5 is an exploded view of a ball pickup mechanism.

Referring to FIG. 5, the ball pickup mechanism 24 comprises a mounting plate 50 having a plurality of outwardly projecting mounting bosses 52. There is a first shaft 54 and second shaft 56 onto which transfer gears 58 and 60, respectively, are mounted. A main gear 62, having concentric extension 64, is mounted to a center shaft 65 and engages transfer gears 58, 60. The gear ratios of the transfer gears to main gear accommodate a ball feed rate of over one hundred and fifty (150) balls per minute. A top cap 66, having a central opening 68, is mounted over concentric extension 64 of the main gear and secured to mounting plate 50 by one or more screws 69. An electric ball feed motor 70 is mounted on the top housing, with at least a portion a ball feed motor shaft 72 protruding through the top housing and oriented toward the transfer gears. The ball feed motor 70, via motor shaft 72, shaft drives the transfer gears 58 and 60 which in turn drive the main gear 62.

A pickup wheel 74 is rotatably mounted to concentric extension 64 of the main gear 62 by a washer and screw combination 76 such that it rotates when the main gear rotates. The front of the pickup wheel includes a plurality of ball pickup structures. By way of example, several pickup fingers 78 are attached at one end to, and protrude from pickup wheel 74. Pickup fingers 78 have curved configuration and are substantially rounded at their free ends. Pickup fingers 78 preferably are constructed of a resilient material, such as plastic, and preferably contain an anti-static additive to help prevent static from pushing balls away from the fingers. Those skilled in the art will appreciate that other materials and/or additives may be used, if desired. The shape of the pickup fingers, the inclusion of anti-static additive, and the slope and angle of the ball feed collector plate combine to reduce the incidence of missed ball pickups.

A plurality of flexible, but resilient ball feed springs 80, 81, 82 are also attached to the pickup wheel. Each of the springs features a lower curved portion 83 suitable for engaging the head of a mounting screw 84, which attaches the spring to pickup wheel 74. It will be appreciated that the springs can be of different lengths. By way of example, spring 80 is a small or short spring. Spring 81 is a long spring that is particularly effective at preventing a semicircular ball jam in plate 23. Spring 82 is medium length spring and has forward 82A portion that is bent or formed at a 90° angle with respect to the rear portion of the spring. Forward portion 82A of spring 82 positioned at the 90° angle is particularly effective at making a sweeping or grabbing pass at balls preventing jamming or bridging of balls. Further, the orientation of forward portion 82A is such that it is effective in moving balls toward the downward angle or slope of plate 23 and toward the left side of ball pickup mechanism 24.

Figure 6:
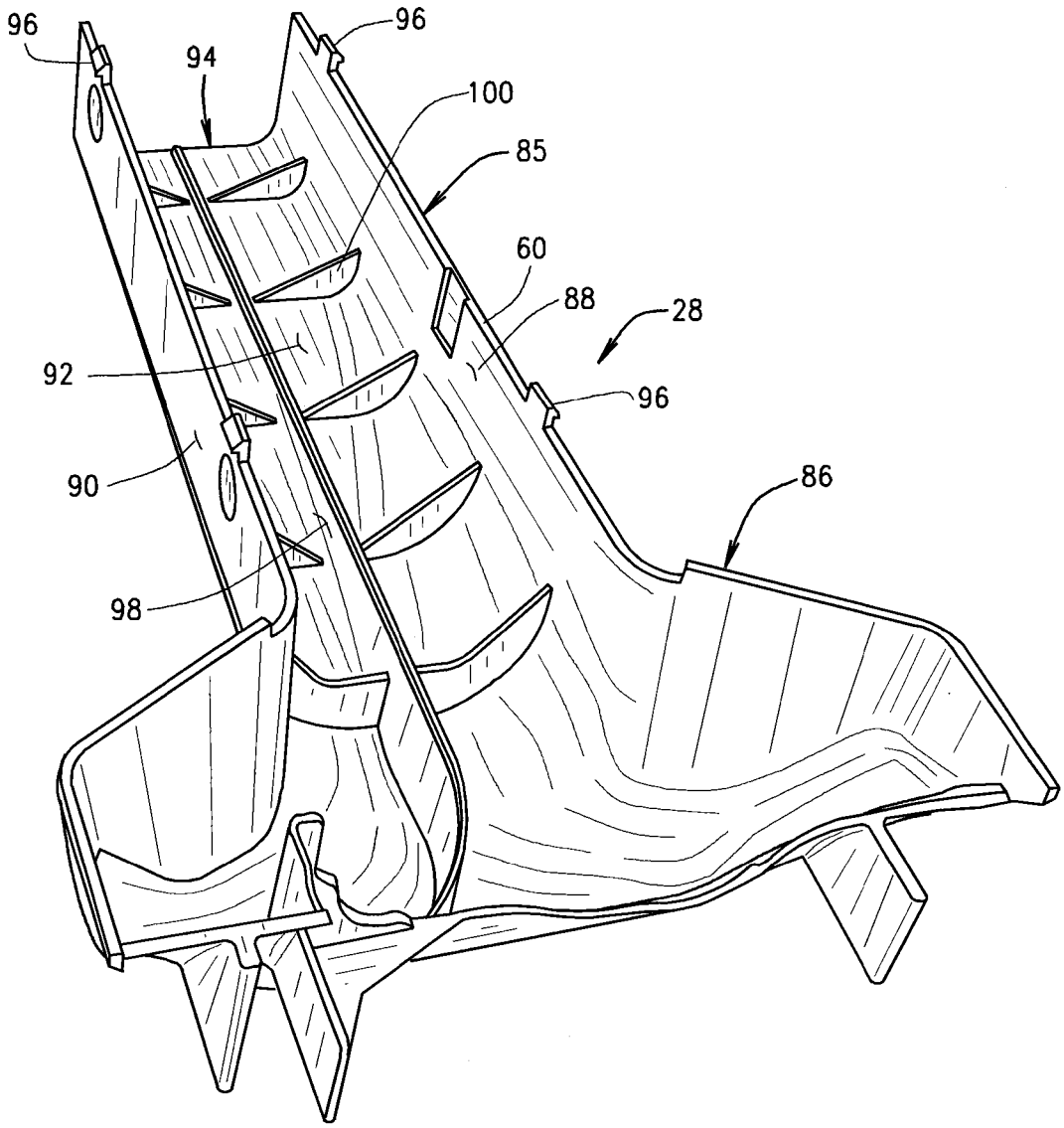
FIG. 6 is a rear perspective view of the of the front cover.

Front cover 28, as seen in FIG. 6, has an upper section 85, which is complementary to the upper portion of back panel 21, and a substantially wider lower section 86. Upper section 85 has a substantially U-shaped cross-section with a first side wall 88 and second side wall 90 and front wall 92. It will be appreciated that where the side walls joint the front wall there is a predetermined radius such that the front cover has a generally rounded, substantially U-shaped cross-section. The two side walls and front wall define a channel 94 that extends the length of the upper section and opens into lower section 86. The lower section is configured complementary to, and abuts, the upper part of the rounded bottom section 22 of back panel 21 and cover at least some of the operational elements of ball pickup mechanism 24. Front cover 28 is attached to the back panel 21 through mounting tabs 96 which fit into slots on the back panel 21. As alluded to above, channel 94 and channel 45 formed by back panel 21 define ball passage 30. Front cover 28 includes a spine 98 on the back side of front wall 92. Spine 98 has a minimal height at the top or upper end of the spine and the height increases along its axial length toward the bottom. Where spine 98 enters bottom section 86 the spine curves. The maximum height of spine 98 is adjacent the curve. Looking at cover 28 from the front, the spine is curved to the right. It will be appreciated that the curvature of spine 98 forms barrier at the lower right side. There is a plurality of laterally extending ribs 100 on the back of front wall 92, each connecting to one of the first or second side walls.

It will be appreciated that the combination of the of front cover 28, particularly the rounded or substantially U-shaped cross-section, the size, shape and orientation of the ball feed springs, and the shape and orientation of the collector plate combine to reduce the number of ball hang-ups where several balls might arrange themselves in such a way to prevent other balls from reaching the pickup mechanism. As explained above, collector plate 23 and ball pickup mechanism 24 optimally direct balls to the left side of the device where there is an open pathway into ball passage 30. Spine 98 orientates and aligns the captured balls in the ball passage. However, as the balls travel up the passage, the decreasing height of spine 98 towards the top allows the ball to orientate more toward the center. Also, it should be appreciated that cover 28 is constructed from a substantially transparent material, such as a substantially clear plastic so that the user can view the ball passage and progress of the balls as they move toward the serving head.

Figure 7:
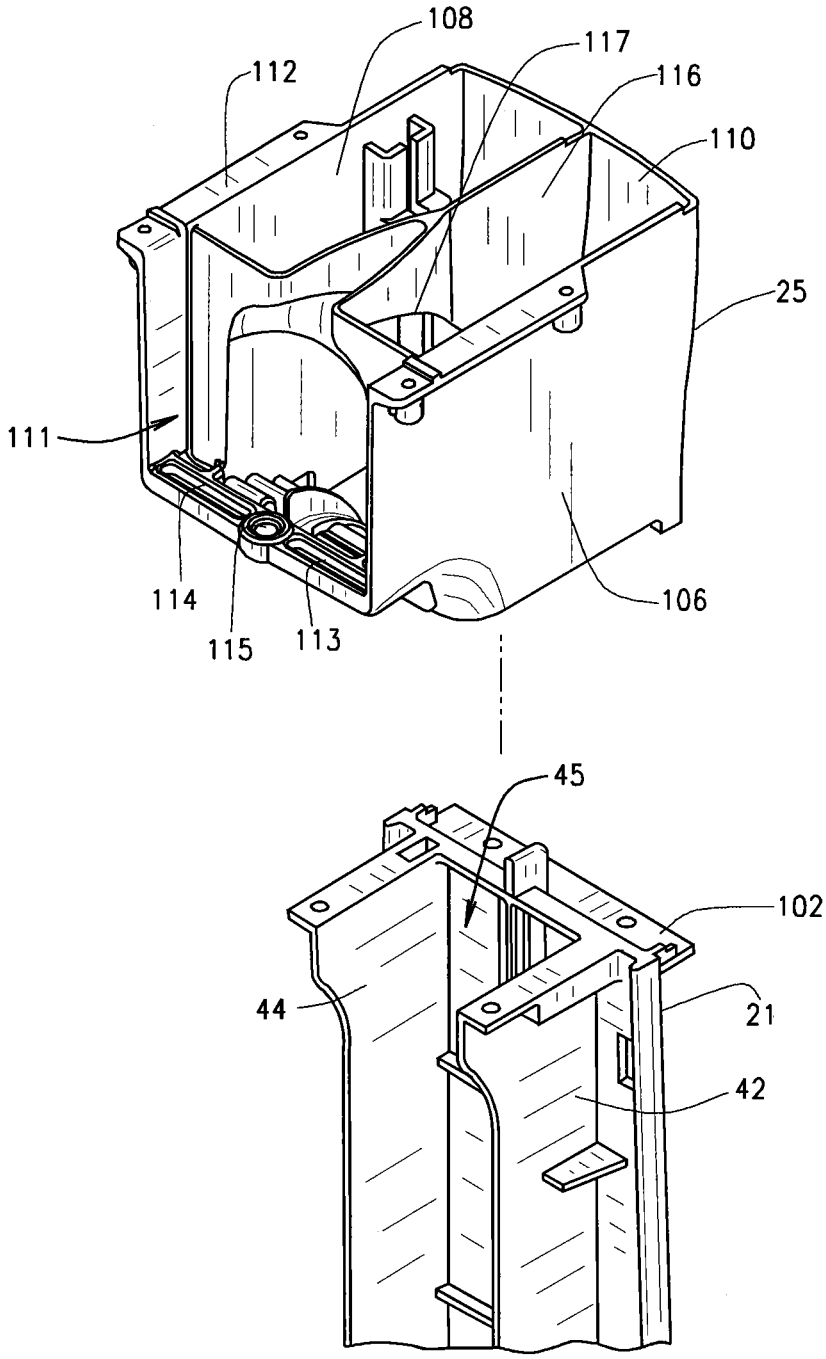
FIG. 7 is a front perspective view of the upper end of the ball feed passage, sans front cover, with the upper ball guide removed therefrom.

Turning to FIG. 7, back panel 21 includes a mounting flange 102. Upper ball guide 25 is mounted at flange 102 and secured with screws or the like. Upper guide 25 is a substantially rectangular shaped enclosure having a first side wall 106, an opposed second side wall 108, and a back wall 110. The front is open, as at 111. Mounting flanges 112 extend along the top edge of each of the side walls. The bottom of upper guide 25 is sufficiently open and sized to mate with ball channel 45 formed by the side walls of the back panel 21. There is an arching ball ramp 113 having ribs 114 thereon leading from the open bottom to the open front 111. There is a pivot pin seat 115 on the forward edge of the ball ramp. A center ball guide 116 is positioned between the inner faces of the side and back walls, of the upper guide 25. Center ball guide 116 extends from the center of back wall 110 and braches outward, splitting into a "wishbone" configuration which terminates on at the mounting flanges. The ball guide and the ball ramp direct balls out of the open front into the serving head.

Figure 8:
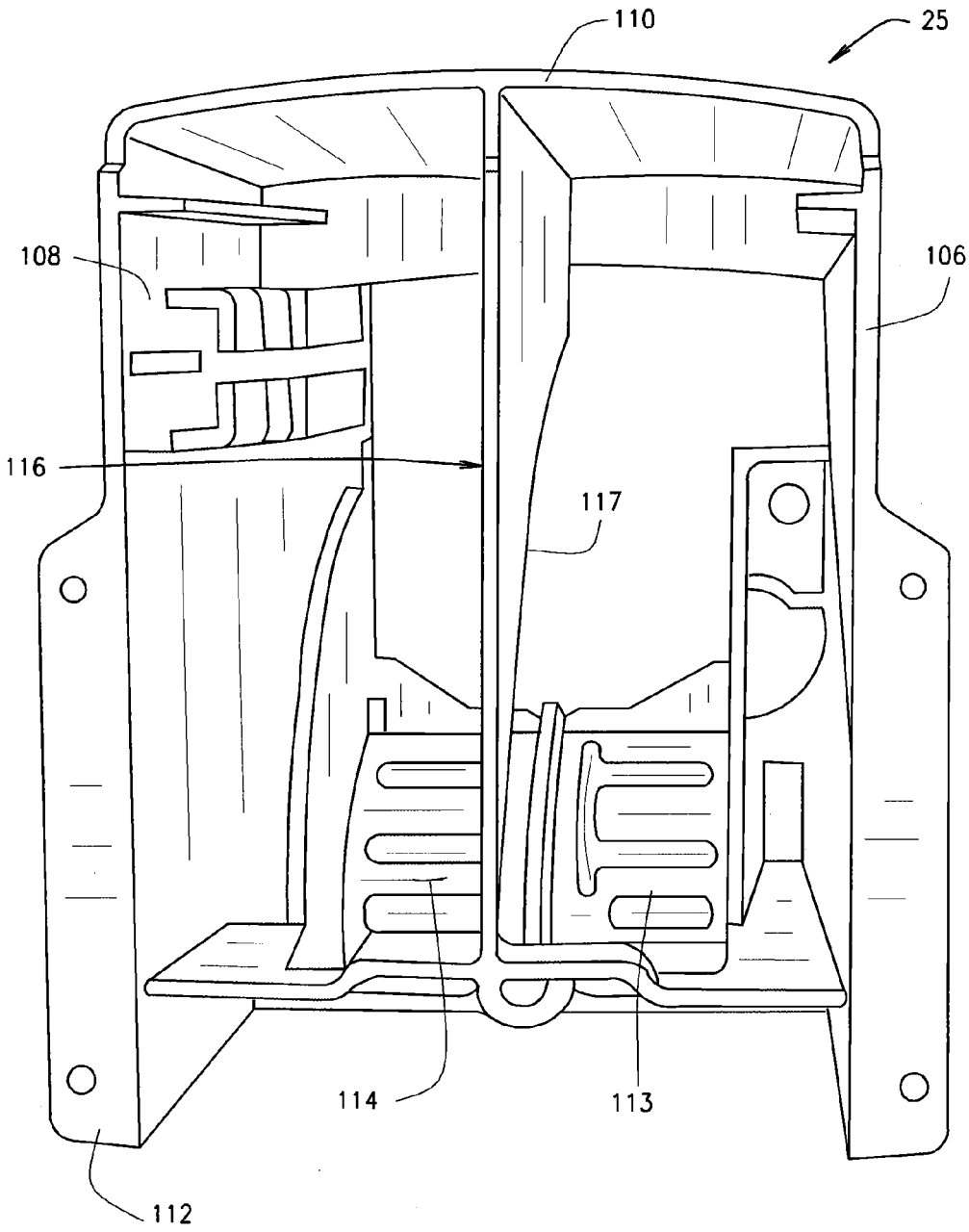
FIG. 8 is a top plan view of an alternative embodiment of a ball guide.

In an alternative embodiment, illustrated in FIG. 8, the double-wishbone center ball guide is replaced by a single T-shaped center ball guide 116 which functions similarly to the double-wishbone design except instead of splitting into a left and right guide (the wishbone shape); it remains a single center guide. In this embodiment, the lower ball guide is removable and is incorporated into a lower cover that covers an opening along the bottom panel of the upper guide. The lower ball guide is incorporated with the cover to facilitate molding of the T-shaped center guide.

In both embodiments of the center guides the bottom edge of the center guides may be have a radius cutout 117 out that is substantially similar to the arc of a ball to better accommodate, guide and a table tennis ball.

Figure 9:
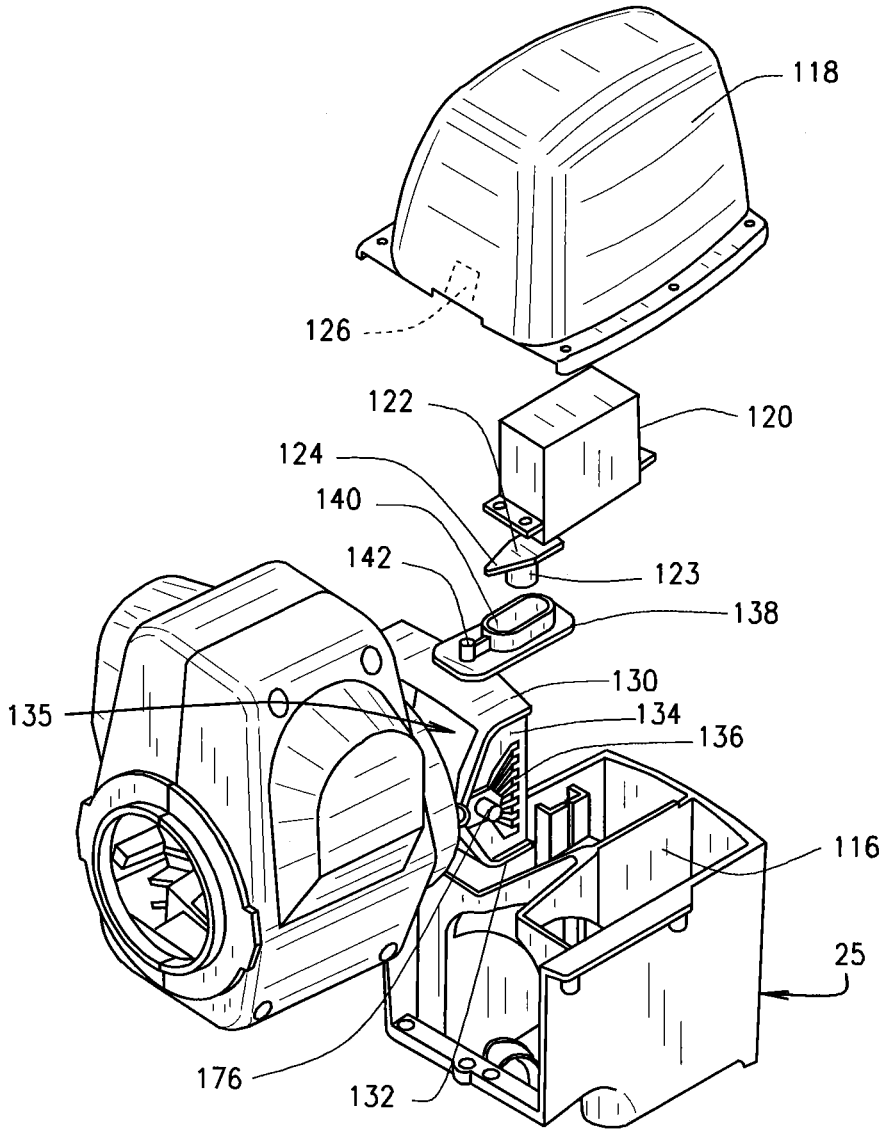
FIG. 9 is a exploded, topm perspective view of the oscillator of the assembly of FIG. 1.

As shown in FIG. 9, oscillator 32 comprises a cover 118, servo 120 secured within the cover in an appropriate manner, and a drive pin 122 operatively associated with the servo. Drive pin 122 includes cam 123. The drive pin also has a front pointer 124 used to align the pin properly during assembly. When assembled properly, this pointer will point at the centerline of the oscillator cover when the head assembly is positioned to deliver balls down the centerline of a table tennis table. There is a pivot guide pivot hole 126 at one edge of the cover. Mounting flanges 128 extend along the bottom edge of each of the sidewalls. The mounting flanges on the oscillator cover align with the mounting flanges on the upper guide. The oscillator 32 is affixed to the upper guide 25 with screws or other attachment means.

A pivot guide 35 is positioned at the lower front edge of the oscillator and in front of upper ball guide 25. Pivot guide includes a top wall 130, a bottom wall 132 and opposed, mirror image side walls 134. The side walls have a pentagonal configuration. The recited walls define a passageway 135 through the pivot guide. Passageway 135 is in communication with the open front of the upper ball guide. There is a serving head angle indicator 136 on at least one side comprising an alpha or numerical scale, locator arrow/slot arrangement or any other appropriate indicia. A tab 138 extends from the top wall of the pivot guide and includes an elongated slot 140. Cam 123 of the drive pin seats in slot 140. There is a top alignment pin 142 on top wall 130 and a corresponding bottom alignment pin (not seen) on bottom wall 132. The top alignment pin is configured to pivotally seat in pivot guide pivot hole 126. Bottom alignment pin is configured to pivotally seat in pivot pin seat 115 of the upper ball guide. Hence, pivot guide 35 can pivot side-to-side. Actuation of servo 120 causes pivot guide 35 to pan side-to-side through the engagement of cam 123 of pivot pin 122 in slot 140 of tab 138. Serving head assembly 34, constructed as set out immediately below, is attached to pivot guide 35 and hence oscillates back and forth with the pivot guide. The back surface has a circular hole sized to accommodate typical sizes of table tennis balls.

Figure 10:
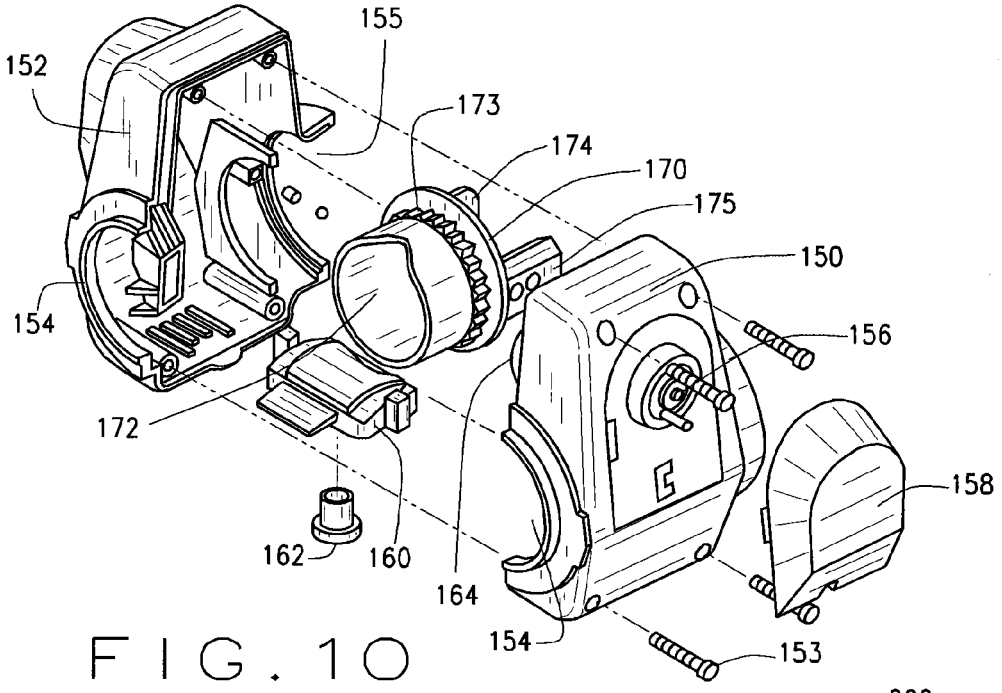
FIG. 10. is an exploded view of the serving head.

As best seen in FIG. 10, serving head assembly 34 has a housing comprising a first half 150 and a second half 152 secured together by screws 153 or similar means. Each half includes a front semicircular cutout 154 and a rear semicircular cutout 155, the respective cutouts cooperating when the housing is assembled to form a front circular opening and a rear circular opening each sized to accommodate the passage of a ball. The rear circular opening is aligned with the pivot guide. As shown, there is a motor 156 associated with the first casing half and protected by a motor cover 158. It will be understood that it would be possible to have a motor associated with each half of the housing if needed.

There is a friction block 160 mounted on a bushing 162 at the bottom of the casing. The bushing consistently positions the friction block. Generally the friction block is formed from a material having a high coefficient of friction, such as durable rubber or the like. A discharge wheel 164 is operatively associated with motor 156 and positioned adjacent friction block 160. Discharge wheel 164 also is formed from a material having a high coefficient of friction.

A discharge tube 170 having a bore 172 sized to accommodate the passage of a ball. The rear end of the discharge tube has a circumferential band of indexing teeth 173 around the surface and a pair of opposed flanges 174, 175 that are pivotally attached to the sides of the pivot guide with a set screw 176 or the like. Hence there is alignment between the discharge tube, the opening in the pivot guide and the upper ball guide. Moreover, because of the pivotal attachment, the serving head assembly can be pivoted up and down to change trajectory and secured in the desired position by the set screw. The relative angle of tilt or trajectory can be reflected by angle indicator 136 on a side of the pivot guide.

The forward or outlet end of tube 170 is positioned adjacent the friction block. When a ball enters the serving head it passes through the discharge tube and is positioned on friction block 160 and then propelled by discharge wheel 164 out of the front of the serving head assembly through the front circular opening. Discharge wheel 164 is mounted such that an outer circumference face of the wheel will just engage a ball as it exists the tube. The speed of the wheel may be varied which will affect the speed at which the ball is traveling as it exits the tube and is propelled outward. It will be understood that serving head assembly is attached to the pivot guide in such a manner that allows it to pivot up and down relative to the longitudinal axis of the robot. Moreover, the head assembly can rotate around the longitudinal axis of the tube. Any number of rotational positions or stops, defined by circumferential indexing teeth 173, allow the head assembly to be secured in a desired position for changing the type of spin on the ball.

Figure 11A:
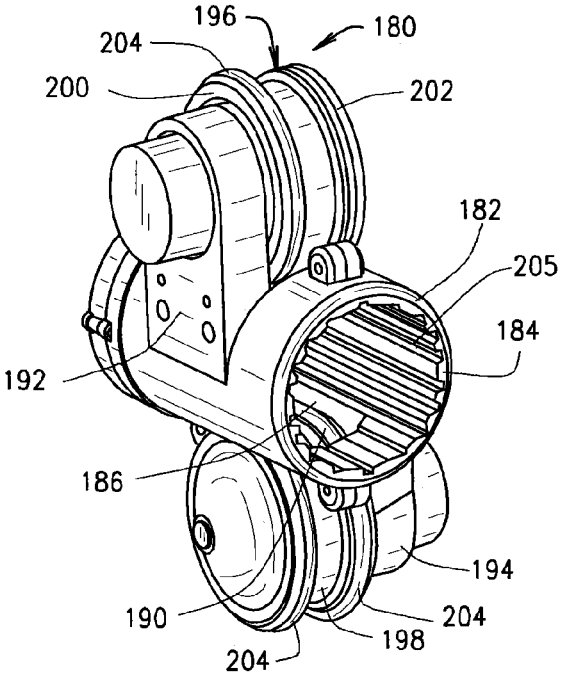
FIG. 11A is a perspective view an alternative embodiment of a discharge tube and discharge wheel assembly.
Figure 11B:
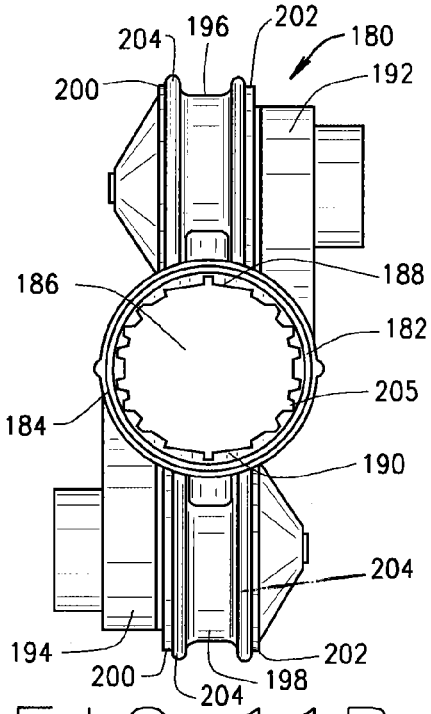
FIG. 11B is a front plan view thereof.

FIGS. 11A and 11B illustrate another aspect of a discharge wheel and discharge tube assembly, indicated generally by reference number 180. Assembly 180 comprises a discharge tube 182. Discharge tube 182 comprises cylindrical wall 184 which defines an inner bore 186. Discharge tube 182 has a somewhat greater axial length than discharge tube 170. There is a first opening 188 through wall 184 and an opposed second opening 190 through the wall. There is a first wheel mounting flange 192 on the wall adjacent the first opening and a second wheel mounting flange 194 on the wall adjacent the second opening. A first discharge wheel 196 is rotatably attached to the first flange and a second discharge wheel 198 is rotatably attached to the second flange. As illustrated, wheels 196 and 198 each have outer rims 200, 202. Each rim includes a covering 204 of material having a high coefficient of friction, such as rubber. The coatings can be applied or preferably they are replaceable, for example, replaceable bands of rubber or O-rings or the like. Wheels 196 and 198 can have more than one rim or O-ring or can have a substantially solid surface of high coefficient of friction material to enhance energy transfer to the ball.

As best seen in FIG. 11B, the rims of the respective wheels protrude slightly into bore 186 through openings 188 and 190. Either one or both of the discharge wheels is operatively associated with a motor for turning the wheel(s). In this assembly the ball enters discharge tube 182, is substantially centered between the rims of the discharge wheels and propelled through bore 186 and out of the discharge head. The rubber O-rings provide a good friction surface against the balls. They contact the ball in two discrete locations of a controllable size, where as a rubber pad would contact the ball in one larger location. This lends a degree of 'self centering' as the ball passes through both wheels. The O-rings are also easily replaced as the wear out, avoiding the need to replace a whole wheel as we do today.

In one aspect, bore 186 of the discharge tube has a fluted inner surface 205, as illustrated. The fluting allows a ball to be ejected from the tube without encountering a great deal of air resistance or turbulence. The flutes act as a channel for air to be displaced and flow smoothly around the ball, instead of being forced out of the tube and slowing or disturbing the ball flight, or allowing the ball to contact the tube before it exits.

Regardless of the discharge tube and wheel configuration, serving head assembly 34 is secured to pivot guide 136 via flanges 174, 175 by shoulder screws or other attachment means which pass through holes at the front of each pentagonal side walls of the pivot guide. The attachment means are constructed so that the serving head assembly can tilt up and down. The serving head angle indicator 146 indicates the angle of adjustment. An adjustment thumbscrew, or other appropriate means, can be employed to fix the serving head at the desired angle. The front surface of the serving head assembly features spin position indicators which indicate various types of spin that may be imparted to the ball as it exits the tube. Top, back, left, and right sidespin for example.

Alternatively, a combination of the aforementioned spins may be imparted to the ball. The type of spin imparted to the ball is controlled by rotating the head assembly around the longitudinal axis of the discharge with respect to the pivot guide, in the direction indicated by the spin position indicators. The spin imparted is indicated by the indicators nearest the top of the head assembly. As the head assembly rotates, the position of the discharge wheel within the head assembly varies accordingly. For example, the discharge wheel can be functionally orientated on the top, bottom, left or right side of the ball and points in between to vary the discharge path, spin and so on.

Figure 12:
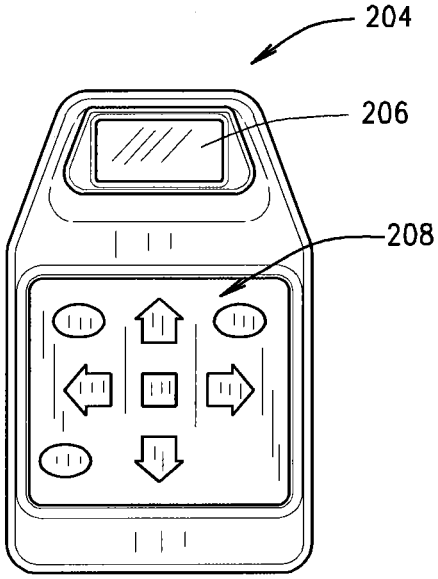
FIG. 12 is a front plan view of the digital controller used in cooperation with the assembly of FIG. 1.
Figure 13:
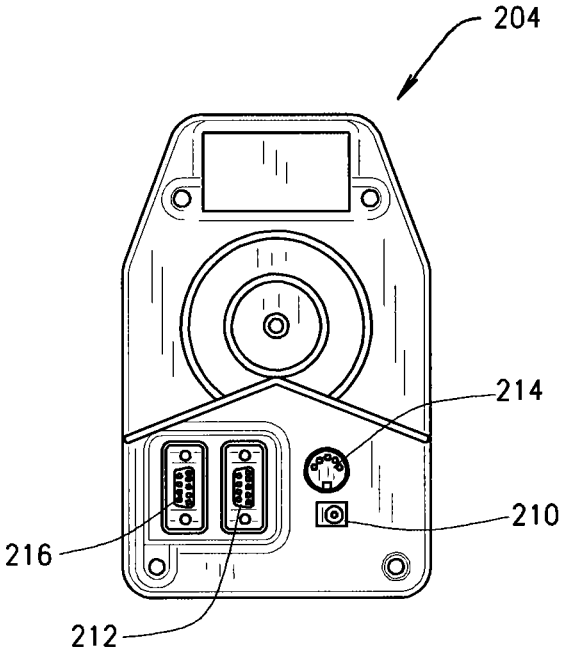
FIG. 13 is a rear plan view thereof.

The table tennis robot is operatively connected to a digital controller, as shown in FIGS. 12 and 13 and indicated by reference number 204. Controller 204 comprises a display screen 206 and a plurality of buttons 208. The plurality of buttons 208 includes a power button, a number of buttons used to navigate menus displayed on the display screen and make choices from the menus and a play/pause button. A back panel of the digital controller has a power input jack 210, a serial connector 212, a 5 pin female connector 214 and a DB-9 male connector 216. A power transformer, as known in the art, connects to power input jack 210 to provide power to the controller. Serial connector 212 is used to connect the controller to a computer to facilitate programming of various drills to be executed by the robot server assembly. The 5-pin connector 214 is used to connect the controller to the robot server assembly, allowing the controller to send instructions to the server assembly, controlling the speed and placement of balls delivered from the robot server assembly. The DB-9 male connector 216 is used to connect the controller to the electronic game, Pong-Master®.

In operation, balls flow into the ball feed collector plate. The motor of the ball pickup mechanism causes the pickup wheel to rotate via the main and transfer gears. As the pickup wheel rotates, the plurality of springs also attached to the pickup wheel rotate, effectively separating balls as they feed into the bottom of the pickup mechanism. As each pickup finger rotates to the bottom of the pickup mechanism, thereby engaging a ball and propelling it upward into the ball channel. As balls build in the queue, they will move upward and into the upper guide.

The ball sensor switch counts each ball as it passes the switch. The sensor sends a signal to the digital controller to allow the digital controller to stop ball delivery after a specified number of balls. The digital controller can also accurately detect when there has been a missed ball pickup and then speed up the rotation of the ball pickup mechanism to maintain a constant flow of balls through the robot server assembly.

The double-wishbone center ball guide forces each ball to travel through the center of the upper guide without hanging up within the guide. Another aspect of the upper guide that helps prevents ball jams is that the upper guide's height and depth are sized to reduce the radius of the center ball guide radius to reduce incidences of balls hanging up in the bend of the ball channel where balls change from going up to going forward as the balls progress through the upper guide. The balls then travel through the pivot guide and into the head assembly.

Once inside the head assembly, the balls are engaged by a spinning rubber wheel. The rubber wheel increases the speed of the balls and imparts spin to the balls as described above. A rubber friction block is mounted in a fixed position inside the head assembly. The friction block directly opposes a spinning wheel. The friction block forces a ball travelling through the head assembly into the spinning wheel and holds the ball against the spinning wheel until the spinning wheel grabs the ball and throws it forward. In the alternative embodiment, the ball enters the discharge tube, having a fluted bore if desired, and the discharge wheels contact the ball at discrete locations. In either arrangement the balls then exit the head assembly, at an angle determined by the position of the head assembly with respect to the pivot guide.

The digital controller, shown in FIGS. 12 and 13, uses a menu-based control system which is much more user-friendly system than the switches, dials, levers, and indicators that all other robots use. FIGS. 14A through 14F illustrate a representative menu listing various aspects of the present invention. The menu system defaults to a "normal mode" when first turned on. Normal mode allows control of ball speed, ball frequency (called Wait Time) and Oscillator position. Additional features may be activated through additional "pages" of normal mode or by switching to Drill mode, where various pre-set patterns of play can be activated. Alternatively, when the digital controller is connected to a Windows personal computer, personal computer mode allows the operation of the robot server assembly to be programmed and controlled directly from the personal computer.

The digital controller uses Pulse Width Modulation to control motor speeds. This will assure that a full 12 volts (or more) will drive the motors at all times instead of only 1 to 2 volts when potentiometers are set to lowest speeds. This will help prevent ball jamming problems, particularly when new or dirty balls are used in the robot server assembly, and other low voltage problems that can occur with the motors used in accordance with the present disclosure.

The digital controller allows for setting oscillation range and eliminates control levers and control lever adapters. Assuming 10 is the location corresponding with the centerline of the table, 0-9 positions indicate locations to the left of the centerline and 11-20, locations to the right of the centerline. The digital controller allows selection of a left and right location. For example, a setting of "L2 R18" will cause one ball to be placed at the left corner (2) and the next ball to be placed at the right corner (18); 0 or 1 would indicate a ball angled across the left sideline with 19 Or 20, one that is angled across the right sideline. Positions 2 and 18 would indicate balls delivered to the left and right corners of the table.

Random settings allow balls to be placed randomly at any position between 0 and 20, to vary ball speed to make ball go shorter or deeper on the table, and also for wait time, so it's more difficult to develop a rhythm. This makes the robot server less predictable and more similar to the way a human would play. The digital controller may be reprogrammed with a computer to correct problems or add new capabilities in the future.

The digital controller can be connected by serial port to a Windows personal computer containing a software program capable of creating "drill files" that can be transferred between users, so for instance, a coach can create 3 drill files for his students to do each day of the current week and then send them new drills after evaluating their progress at the end of that week. Optionally, a community of players with robots can swap files amongst themselves. Drill files will define motor speeds, ball locations, and delay between sequential shots. There is no limit to the number of consecutive balls that can be included in a drill file.

A "Drill" mode will have a set number of standard drills that can be run by the digital controller without having the digital controller connected to a personal computer. Ball speed and wait time for the drill may be adjusted so a single drill will be suitable for a wide range of playing skills. The robot will come with 64 standard drills installed. The first 32 will be factory default drills and cannot be overwritten. The last 32 can be overwritten, allowing customized drills to be saved onto the digital controller.

A "Normal" mode allows for individual control over motor speeds and allows for setting the ball locations much more exactly, much finer control over the exact delay between consecutive shots, and being able to stop delivery after either a certain number of balls have been delivered or a certain amount of time has elapsed.

A "Set-Up" mode allows for calibration of settings and selection of options.

The "Count/Time" option allows ball delivery to be controlled by the number of balls (in Normal mode), the number of repetitions (in Drill mode), or the amount of time.

The serial port allows robots to be linked together so that all controllers can be controlled by a single digital controller. As one skilled in the art will recognize, any suitable serial or parallel communications interface could be used in place of the serial port, including but not limited to Universal Serial Bus or FireWire. Additionally, wireless communication interfaces such as WiFi or Bluetooth would also be suitable.

The digital controller receives a signal from the ball sensor switch in order to detect when there has been a missed ball pickup. The digital controller then quickly accelerates the ball pickup mechanism so there is very little delay in wait time between shots.

The device may be appropriately programmed so that the menus in the menu system may be displayed in English, German, French, Spanish, Chinese, and Japanese. There is even a special feature where language can be selected even if the digital controller is already set in a language that the user cannot read.

The digital controller may be set for left or right hand operation, so that drills run correctly for left-handed or right-handed players. The speed and oscillation can be calibrated to a known standard so that drills written for one robot can be shared, and run correctly, by many other robots. The ball sensor can be calibrated to a particular ball feed mechanism to eliminate missed or delayed pickups or double throws.

A Ball Unloading special feature allows balls to be unloaded from the ball trays or ball bucket. Activating this feature causes the ball feed motor to run at maximum speed (170 balls/min), removing the balls from the ball trays and depositing them into a box placed under the ball discharge hole.

The digital controller also includes Factory Default Restoration and Self-Diagnostic special functions that restore settings to the factory default settings and produce troubleshooting codes to allow a technician to quickly tell if the digital controller is functioning properly.

The software program is installed on a Windows personal computer and interfaces with the digital controller via a serial cable or other suitable interface. The software program allows a user to read and write drills back and forth to the digital controller, to create new drills from scratch, run drills directly from the personal computer, and to save drill files on the personal computer. The software program can also restore all 64 drills stored in the digital controller to the original factory settings.

Figure 15:
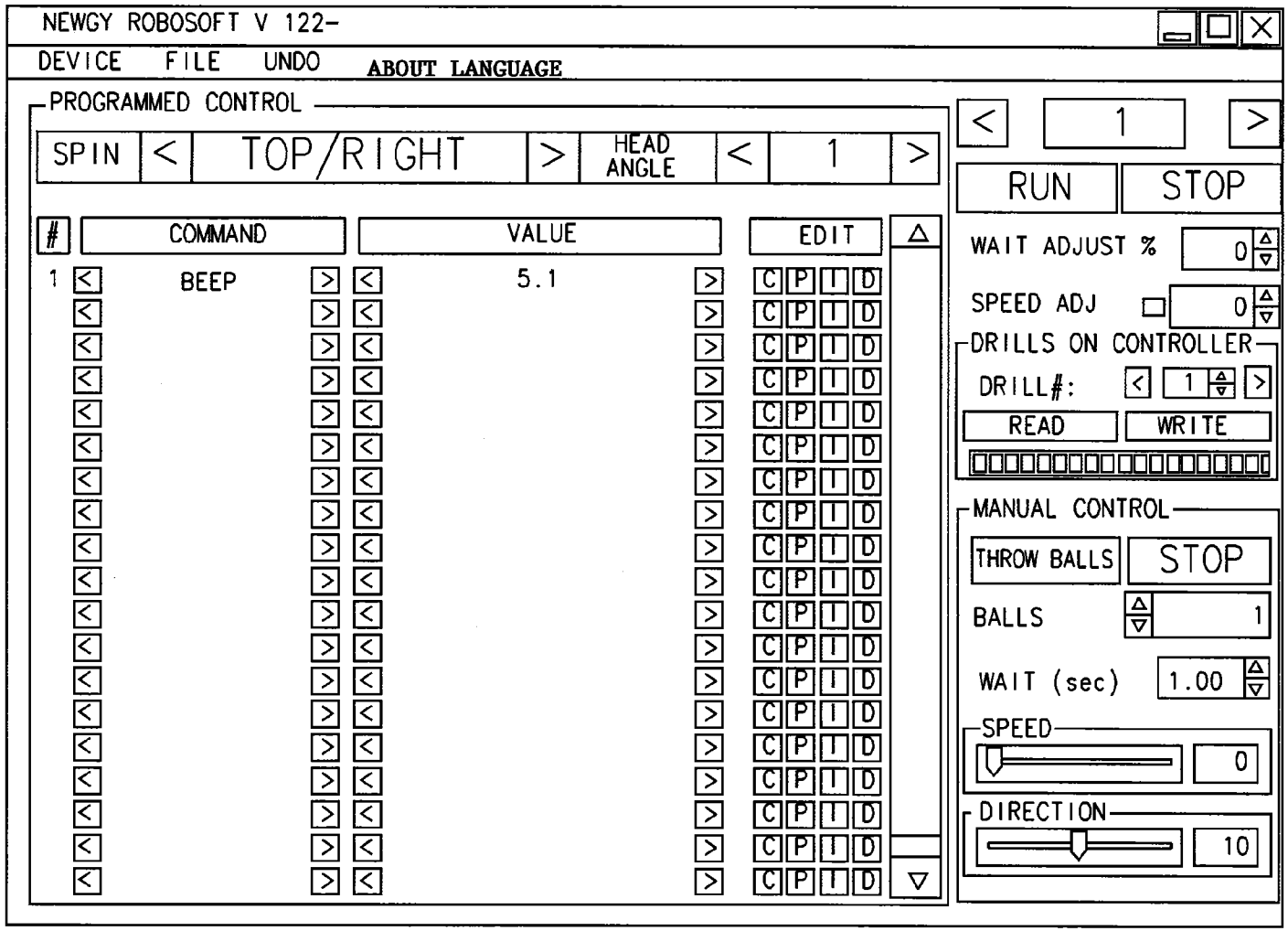
FIG. 15 is a computer screen shot illustrating software applications for programming and operating a table tennis robot from computer. The screen is illustrative only and any appropriate screen managed by the operating system software that can be used to manage the functions in a user friendly manner is encompassed by the scope of the invention. For example, various textual or alphanumeric indicators, such as C,P,I & D can be replaced by graphic symbols.

FIG. 15 shows a user interface screen of the software program. A drill is created using the controls under the "PROGRAMMED CONTROL" heading shown in FIG. 15. A drill consists of a series of sequence steps. A sequence step is created by first selecting a command using the arrows under the "COMMAND" heading. The valid commands consist of position, throw, wait, beep and speed. When a command is selected, the next consecutive sequence number is automatically added by the software program under the "#" column.

After a command is selected, a value is assigned to the command using the arrows under the "VALUE" column, or by using a pointing device to select the text under the value column and a keyboard or other input device to input the desired value. For the position command, the value ranges from 1-20, and denotes the location where the ball will be thrown with respect to the centerline as described above. For the wait command, the value ranges between 0 and 12.75 seconds and denotes the time in seconds to wait before the next ball is thrown. The beep command has a value which contains two comma separated values, each ranging from 0 to 10. The first value controls the tone of the beep and the second the duration of the beep on a relative scale of length from 0 being very short and 10 very long in duration. The speed command has values which can range from 0 to 30, which denote the speed at which the ball is expelled from the server assembly.

The "EDIT" column consists of four buttons labeled "C", "P", "I" and "D". The "C" button is used to copy the command and value from the corresponding sequence step. The "P" button can then be used to paste the copied command and value into a different sequence step, creating a new sequence step. The "D" button is used delete the sequence step that corresponds to the "D" button. The "I" button is used to create a new sequence step before the sequence step which corresponds to the "I" button selected. These letters are representative only, and may be replace with graphical symbols so the software is more universal among supported languages.

Drill files may be saved onto the personal computer for later use by selecting the Save command from the File menu. A dialog box will then appear which allows the drill file to be given a distinctive name. Drill files which have between previously saved can be recalled using the Open command on the File menu. Selecting the open command will display a dialog box which allows the user to navigate to a previously saved drill file. Once a drill file is selected, the sequence steps from the drill appear.

The spin and head angle are specified by selecting new values using the arrows next to the displayed values. Spin may be selected from top, back, left, right, top/left, top/right, back/left and back/right. The head angle ranges from 1 to 13 and corresponds to the markings on the pivot guide Drills may be read from and written to the digital controller using the controls under the heading "DRILLS ON CONTROLLER" as shown in FIG. 8. A drill is read or written by first selecting the drill number using the arrows next to the number. The read button is used to read the drill currently stored in the digital controller corresponding to the number selected. Similarly, the current drill sequence can be written to the digital controller at the number corresponding to the number selected on the program screen. One skilled in the art will recognize that by utilizing drills stored on the personal computer and the "DRILLS ON CONTROLLER" feature, a user can readily maintain many more than 64 drills on the personal computer, selecting which 64 are present in the digital controller at any point in time.

The software program also allows manual control of a number of balls to be thrown and the time between balls as well as the speed and direction of the balls. This would be used to test the speed and position of individual balls in a drill as the user is creating a drill. Manual control is accomplished by using the buttons under the "Manual "Control" heading at the lower right of the screen shown in FIG. 15.

The above examples show that the disclosure, as defined by the claims, has far ranging application and should not be limited merely to the embodiments shown and described in detail. Instead, the disclosure should be limited only to the explicit words of the claims, and the claims should not be limited to the detailed embodiments shown in the specification, which represent the best modes of the disclosure and not the extents of protection. The scope of protection is only limited by the scope of the accompanying claims, and the Examiner should examine the claims on that basis.

We claim:

1. A robot server assembly for serving table tennis balls comprising:

a back panel having an upper end and a lower end, said back panel having a first side wall and a spaced apart second side wall, said side walls being perpendicular to said back panel;

a ball feed collector plate at the lower end of the back panel and configured to collect table tennis balls and direct them toward the lower end of the back panel;

a ball pickup mechanism at the lower end of the back panel and orientated toward the ball feed collector plate, said ball pickup mechanism having a rotatably mounted pickup wheel and a ball feed motor operatively connected to the pickup wheel, said pickup wheel having a plurality of ball pickup structures extending from the pickup wheel toward the collector plate;

a ball guide at the upper end of the back panel, said ball guide having a open bottom and an open front;

a front cover attached to the back panel having a substantially U-shaped cross-section, said front cover and said side walls of the back panel defining a ball passage, said passage having a first open end in communication with the open bottom of the ball guide and a second open end in communication with the ball pickup mechanism;

a pivot guide pivotally mounted at the open front of the ball guide and having a passageway in communication with said open front;

a serving head assembly attached to the pivot guide and comprising at least one discharge wheel and a discharge tube in communication with the pivot guide passageway; and an oscillator at the top of the ball guide and operatively connected to the pivot guide, said oscillator having a servo and pivot pin arranged to move the pivot guide and the attached serving head assembly in a side-to-side pattern when the servo is actuated.

2. The robot server assembly of claim 1 wherein the front cover is constructed from a substantially transparent material.

3. The robot server assembly of claim 1 wherein the ball guide further comprises a center guide.

4. The robot server assembly of claim 3 wherein the center guide has a T-shape configuration.

5. The robot server assembly of claim 3 wherein the center guide has a wishbone configuration.

6. The robot server assembly of claim 1 wherein the plane of the ball collector plate is orientated at an angle relative to a longitudinal axis of the back panel.

7. The robot server assembly of claim 1 wherein the discharge tube has an inner bore with a longitudinally fluted surface.

8. The robot server assembly of claim 1 wherein the discharge tube has at least one opening formed therein and wherein the discharge wheel extends part way into the opening.

9. The robot server assembly of claim 8 wherein the discharge tube has at least a second opening formed therein opposite said first opening and a second discharge wheel that extends part way into the second opening.

10. The robot server assembly of claim 1 wherein the discharge wheel has a pair of opposed rims, each said rim having a high coefficient of friction covering.

11. The robot server assembly of claim 1 wherein the ball pickup structures comprise resilient fingers.

12. The robot server assembly of claim 1 wherein the ball pickup structures comprise springs.

13. The robot server assembly of claim 12 wherein the springs further comprise at least three springs, each of said springs being of a different linear dimension, at least one of said springs having a forward section disposed at a 90° angle.

14. The robot server assembly of claim 1 further comprising a digital controller that operates functions of the robot server assembly from a menu of functions.

15. The robot server assembly of claim 14 wherein the digital controller further comprises:

a display screen, a plurality of buttons and a digital interface;

the digital controller operatively connected to the robot server assembly through the digital interface;

the digital controller configured to display menu choices on the display screen; and the plurality of buttons configured to select particular menu choices corresponding to operating modes of the robot server assembly.

16. The robot server assembly of claim 14 further comprising an interface between a personal computer and the digital controller and a software program allows a user to perform one or more functions selected from the group of functions consisting of selecting a language, reading and writing drills back and forth with the digital controller, creating new drills, running drills directly from the personal computer, saving drill files on the personal computer, and restoring drills stored in the digital controller to original settings.

17. The robot server assembly of claim 1 further comprising a tray and net assembly for capturing balls and directing them to the ball pickup mechanism.

18. A robot server assembly for serving table tennis balls comprising:

an elongated back panel and having an upper end and a lower end, a first side wall and a spaced apart second side wall, said side walls being perpendicular to said back panel;

a ball feed collector plate at the lower end of the back panel, said collector plate having raised a perimeter lip and positioned at an angle relative to the longitudinal axis of the back panel so as to collect table tennis balls and direct them toward the lower end of the back panel;

a ball pickup mechanism at the lower end of the back panel and orientated toward the ball feed collector plate, said ball pickup mechanism comprising a rotatably mounted pickup wheel with a plurality of ball pickup structures thereon outwardly extending toward the ball feed collector plate, at least one of said ball pickup structures being a resilient finger, and at least one of said ball pickup structures being a spring; a gear drive assembly and a ball feed motor operatively associated with the pickup wheel, a ball guide at the upper end of the back panel, said ball guide defining an open bottom and an open front, said ball guide comprising a central ball guide having a wishbone configuration;

a substantially transparent front cover attached to the back panel having a substantially U-shaped cross-section, said front cover and said side walls of the back panel defining a ball passage, said passage having a first open end in communication with the open bottom of the ball guide and a second open end in communication with the ball pickup mechanism;

a pivot guide mounted at the open front of the ball guide and having a passageway in communication with the open front of the ball guide, said pivot guide being pivotally mounted so as to be movable in a side-to-side pattern;

a serving head assembly pivotally attached to the pivot guide so as to be moveable in an up and down manner, said serving head assembly comprising at least one discharge wheel and a discharge tube in communication with the pivot guide passageway; and an oscillator at the top of the ball guide and operatively connected to the pivot guide, said oscillator having a servo and pivot pin arranged to move the pivot guide and the attached serving head assembly in a side-to-side pattern when the servo is actuated.

19. The robot server assembly of claim 18 further comprising a bushing with a friction block on the bushing, said friction block being positioned adjacent the discharge wheel.

20. The robot server assembly of claim 18 wherein the discharge tube comprises a cylindrical wall having a fluted inner surface.

21. The robot server assembly of claim 18 further comprising a discharge tube having a cylindrical wall defining a bore and having a first opening through the wall into the bore and an opposed second opening through the wall into the bore, and a first discharge wheel extending into the bore through the first opening and a second discharge wheel extending into the bore through the second opening.

* * * * *